United States Patent [19]

Blickenderfer

[11] 4,333,373

[45] Jun. 8, 1982

[54] POSITIONING AND FEED SYSTEM FOR CANTS AND BOARDS

[75] Inventor: Charles Blickenderfer, Puyallup, Wash.

[73] Assignee: Weyerhaeuser Company, Tacoma, Wash.

[21] Appl. No.: 192,278

[22] Filed: Sep. 30, 1980

[51] Int. Cl.[3] ..... B27B 5/00; B26D 7/06

[52] U.S. Cl. ..... 83/419; 83/421; 83/367; 83/732; 83/520; 83/425.3; 144/245 A; 144/242 E; 144/378; 198/457

[58] Field of Search ..... 83/367, 418, 419, 421, 83/425.3, 435.2, 520, 732; 144/2 R, 3 R, 312, 242 E, 245 R, 245 A; 198/382, 395, 434, 457, 592

[56] References Cited

U.S. PATENT DOCUMENTS

| | | | |
|---|---|---|---|
| 1,824,381 | 9/1931 | Sorensen et al. | 83/367 X |
| 3,690,435 | 9/1972 | King et al. | 198/592 X |
| 3,806,253 | 4/1974 | Denton | 144/312 X |
| 3,811,487 | 5/1974 | Warren et al. | 144/312 |
| 3,970,128 | 7/1976 | Kohlberg | 144/312 X |
| 4,196,648 | 4/1980 | Jones et al. | 144/312 X |
| 4,231,460 | 11/1980 | Heikinheimo | 83/367 X |
| 4,294,149 | 10/1981 | Olsson | 144/312 X |

*Primary Examiner*—Frank T. Yost
*Assistant Examiner*—Robert P. Olszewski

[57] ABSTRACT

An improved positioning and feed system for cants or boards has the capability for skewing and offsetting at a pre-positioning station with respect to the saws of a sawing machine. At a pre-positioning station, at least one visible line is directed to and impinges upon an incoming piece. An operator, through the use linear positioners and a first set of movable pins, pre-positions the individual piece with respect to the reference line, skewing and offsetting it as necessary. Once the orientation is selected, a downstream second set of pins which assume the same position as the first set will be moved upwardly. The first set of pins will be retracted, allowing a conveyor table to convey the piece to the pre-positioned second set of pins. With the piece in its pre-priented position, the conveyor table is then moved vertically downward allowing the piece to lie atop a longitudinal infeed conveyor. Additional pins may be utilized according to the particular type of incoming cant or board.

11 Claims, 11 Drawing Figures

POSITIONING AND FEED SYSTEM FOR CANTS AND BOARDS

BACKGROUND OF THE INVENTION

This invention relates generally to positioning and feeding systems for use within sawmills. More particularly, it relates to a positioning and feed system for use in secondary breakdown machines such as edgers and rotary gangs.

In almost all typical modern sawmills, individual logs are first broken down longitudinally at a primary breakdown station. This step normally produces at least one cant having two flat surfaces and usually two curvilinear surfaces representing portions of the log surface. In addition, side boards are usually produced, also having two flat surfaces and two curvilinear surfaces. Slabs are also produced having one flat surface with the balance being a portion of the log surface. These resulting pieces then undergo further breakdown at secondary breakdown stations. Boards-that is, relatively thin pieces that are suitable for being edged into a dimensional product-will be directed to edging machines while the larger, thicker, wider cants will be directed to rotary gang machines for further breakdown into a plurality of rectangular pieces of dimension lumber with some resulting edgings.

When cants and unedged boards are cut from a log that has bow or curvature in it, the resulting piece will also have a curved axis in the longitudinal direction. It has been recognized that in order to gain the optimum number of pieces or value from a cant or board that has curvature in it, skewing and offset with respect to the center line is necessary. By being able to skew a cant or board to account for bow, knots, wane and other defects affecting the angle of cut, it has been determined that approximately five percent additional lumber recovery may be obtained. Once the cant or board is optimally positioned by skewing and offsetting with reference to the saw lines, it must then be transported through the saws in the same orientation.

In the past, most sawing machines have utilized so-called "line bars" which simply adjust the lateral position or offset of a cant or board before it is transported into the saws. Line bar mechanisms do not allow for skewing and, therefore, cannot provide optimum positioning for maximum lumber recovery.

Other systems to provide better positioning utilize retractable, skewable stops or pins in place of a line bar to position cants or boards ahead of a sawing machine. Whenever a workpiece is individually positioned after having been conveyed transversely from one direction to then be fed in a longitudinal direction, time is wasted while the workpiece is being positioned. It, thus, would be desirable to not only provide the optimum positioning capability but also a system that maintains the overall production through the positioning and feed system.

Thus, from the foregoing, one object of the present invention is to optimally position a cant or board with respect to the saws prior to being fed into the sawing machine.

A further object of this invention is to increase the number of cants or boards that are fed through the sawing machine in the more optimum orientation.

These, and many other objects of the present invention, will be better understood and more fully appreciated upon reading the specification to follow in conjunction with the attached drawings.

SUMMARY OF THE INVENTION

Briefly stated, this invention is practiced in one form by transversely feeding cants to a stop and loader where they are individually fed into a prepositioning station at which station an operator positions the cant or board by manipulating a first set of two upwardly extending retractable stops with reference to at least one longitudinally extending visible line directed along the length of the cant or board. The line acts as a reference line with respect to one of the saws in a downstream sawing machine. A second set of stops, spaced laterally downstream from the first set, is moved simultaneously with the first set. After the optimum offset and skewed position is selected, the first set is lowered and the cant moves transversely into the feed station where the second set, having been prepositioned, will accept the incoming cant or board. At this station, which is substantially in line with the downstream sawing machine, one edge of the cant or board is positioned optimally with respect to the saw lines. At this point, the transversely moving conveying system is lowered, leaving the cant or board atop a longitudinally extending infeed conveying system. Once the transverse conveying system and the second set of stops are retracted, the cant or board is then fed longitudinally into and through the downstream sawing machine in its pre-set orientation.

DETAILED DESCRIPTION OF THE PREFERRED EMBODIMENT AND BEST MODE

Figure 1:
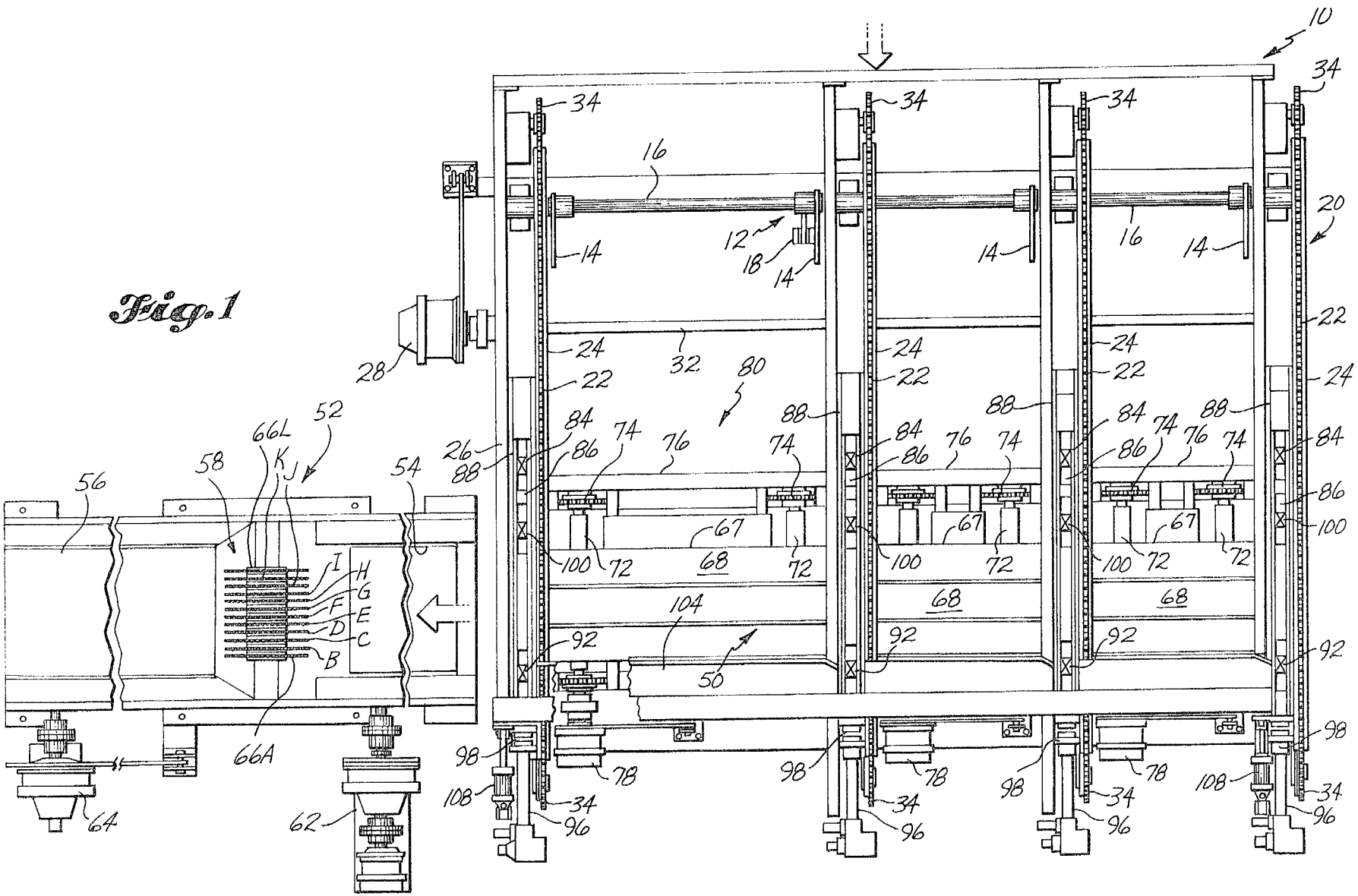
FIG. 1 is a top plan view with portions cut away showing the present invention.
Figure 3:
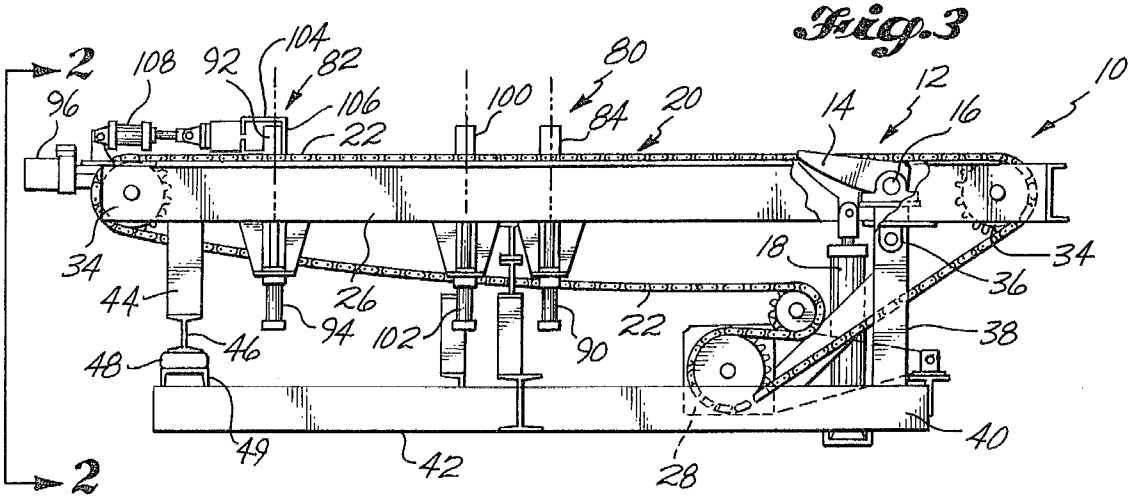
FIG. 3 is also a side elevation view taken along line 3—3 of FIG. 2.
Figure 2:
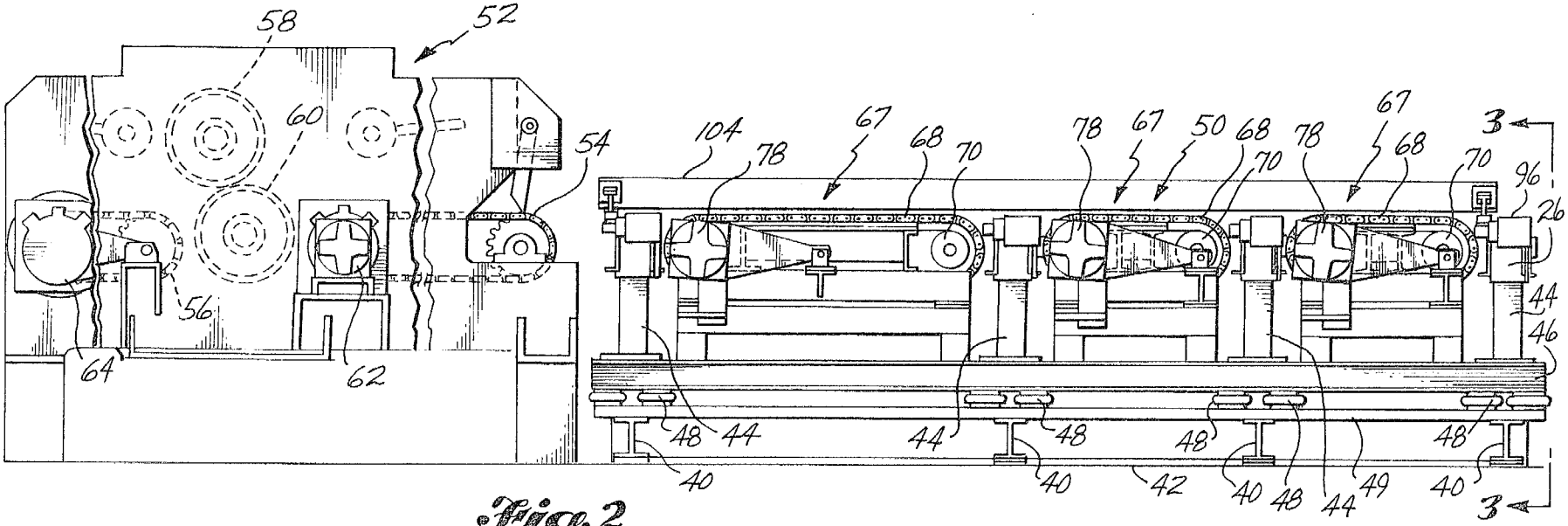
FIG. 2 is a side elevation view taken along line 2—2 of FIG. 3.

Referring first to FIGS. 1–3, an overall general description of the positioning and feed system will be given. At the infeed end, generally indicated at 10, elongated cants or boards are transversely fed to a stop and loader means, generally indicated at 12, consisting of a plurality of movable arms 14 on shaft 16. Means 12 can be of any suitable type that is well-known in the art for temporarily holding individual boards or cants and then releasing them as needed for further downstream processing. It can also, if necessary, be operable to "flip" boards and cants over, as needed. At least one actuating cylinder 18 is provided to actuate arms 14. Serving to move the incoming cants and boards in a transverse conveyor table, generally indicated at 20, consisting of a plurality of four endless conveying chains 22. Each endless chain 22 is mounted in a conveying channel 24 which, in turn, is securely fixed to the conveyor table frame, generally indicated at 26. Serving to drive chains 22 in a controllable manner is reversible motor 28 which serves to drive line shaft 32. A plurality of sprockets 34 at either end of conveyor table 20 serve to support endless chains 22 so the top run is in a substantially horizontal plane. This configuration of endless conveying chains and sprockets constructed to form a conveyor table is well-known.

The conveyor table frame 26 is elevated from ground level and is constructed so as to be pivotal about a longitudinal axis adjacent infeed end 10. Frame 26 is mounted on bearings 36 which, in turn, are mounted on upstanding beam members 38. Beam members 38 are, in turn, supported by a plurality of horizontally extending I-beams 40 which, in turn, are mounted at ground level 42. At the other end of conveyor table 20, the plurality of beams 44 extend downwardly toward ground level 42. At their lower ends, beams 44 are fixed to a substantially horizontally extending I-beam 46 which is supported on a plurality of collapsible, controllable air bags, each indicated at 48. The air bags 48, in turn, are supported by a suitable plate 49 extending across I-beams 40. Thus, I-beam 46 provides a rigid base for support beams 44 and is capable of being moved vertically up and down, thereby pivoting the entire table frame 26 up and down as air bags 48 are controllably pressurized and depressurized. It is important that the vertical distance extending between the bottom of table frame 26 and the tops of I-beams 40 be a dimension suitable for containing various other operating elements, as will become apparent shortly. Air bags 48 are selected, along with a source of pressurized air, so as to provide a range of movement for table frame 26 from a substantially horizontal orientation as depicted in FIG. 3 to a retracted or dropped configuration which will have the upper edges of conveying chains 22 at a level below the plane of the longitudinal conveying means to be described shortly. As will be appreciated by those skilled in the art, air bags have been used for similar applications and their use is well within the skill of one familiar with the art. Other suitable means for pivoting frame 26 may be used. The primary function of conveyor table 20 is, of course, to transversely bring in individual cants and place them atop a conveying system for subsequent longitudinal feeding into a sawing machine. When conveyor table 20 pivots downwardly after a cant has been fed transversely across its length, the endless chains will place the cant atop the longitudinally extending conveyor system, generally indicated at 50.

Positioned longitudinally downstream from conveyor system 50 and conveyor table 20 is the sawing station, generally indicated as 52, comprising, in the embodiment depicted, a double arbor rotary gang sawing machine. The rotary gang machine is typical of those currently in use in the sawmill industry and is comprised of infeed and outfeed conveyors 54, 56, respectively, and upper and lower banks 58, 60 repectively of round saw blades. The horizontal plane of the top surfaces of infeed and outfeed conveyors, 54, 56, is in the same plane as the upper surface of conveyor system 50. Motors 62, 64 serve to turn conveyors 54, 56.

In FIG. 1, a plurality of twelve round saws, 66-A-66-L, are mounted on their respective arbors in a substantially fixed laterally spaced orientation. Saws 66-A-66-L are spaced apart a predetermined distance according to the target size desired for the lumber to be cut.

With existing cant positioning and feed systems, a movable line bar will serve to stop a transversely moving incoming cant and offset it with respect to at least one saw, thereby aligning one edge of the cant or board with respect to the saw lines.

Turning now back to a more detailed description of conveyor system 50, it may be seen with particular reference to FIG. 2 that it is comprised of three longitudinally spaced conveyor sections, each indicated at 67. The conveyor system 50 is structured to allow conveyor table 20 to move up and down without interference from conveyor system 50. Each conveyor section 67 is comprised of endless conveyor chains 68, trained about suitable sprockets 70. The support shafts 72 holding sprockets 70 are supported in suitable bearings 74, mounted within fixed frame elements 76. Provided to power each conveyor section 67 is a suitable drive motor 78, all of which are controlled so as to drive the sections in a uniform manner. Conveyor sections 67 can, of course, be constructed of other suitable elements which will be apparent to those skilled in the art.

Turning now to a detailed description of the improvement comprising the present invention, reference will continue to be made to FIGS. 1–3. A prepositioning station is generally indicated at 80 and a final positioning and feed station at 82. Prepositioning station 80 is located downstream and is laterally spaced from stop and loader means 12. A first set of vertically and laterally movable positioning pins, each indicated at 84, serve the prepositioning function at station 80. In the embodiment depicted, four pins are longitudinally spaced with each being adjacent to one of the endless conveyor chains 22. In the neutral position, pins 84 are substantially in line, but each can be adjusted laterally with respect to another in order to set skew and offset, as will become apparent. Pins 84 are mounted on slide blocks 86 which, in turn, are mounted within transversely extending slide channels 88, mounted on table frame 26. Slide channels 88 extend from a location upstream from prepositioning station 80 to a location slightly downstream from the final positioning and feed station 82. Each positioning pin 84 is mounted in its slide block 86 in order to be vertically movable from a retracted positon below the top run of conveying chains 22 to an upstanding position which is high enough to stop and hold a large cant or board while chains 22 are running. In FIG. 3, an actuating cylinder 90 is depicted which extends downwardly from each respective slide block 86 and is fixedly connected to its respective pin 84 to provide the vertical movement. Each pin has an actuating cylinder 90 so the pins can be individually controlled. The total longitudinal dimension between the left pin (the left-most pin in FIG. 1 at prepositioning station 80) and the right pin will be approximately fourteen feet in order to accommodate the longest cants and boards that will be fed into the system. The dimension between the first (left) and second pins will be approximately six feet with the distance between the second and third and third and fourth pins being approximately four feet. These are exemplary dimensions only and should not be taken to limit the scope of the invention.

Located in a spaced manner along the downstream side of final positioning and feed station 82 is an equal number of positioning pins 92 comprising a second set of vertically moveable laterally adjustable positioning pins. In the neutral position, the second set of pins 92 will be approximately in line within sawing machine 52 and saws 66-A. Pins 92 are similarly mounted in slide blocks 86 and each has independent actuating cylinders 94 for moving them vertically up and down in a manner similar to pins 84. Serving to move the first and second sets of pins transversely by moving the slide blocks 86 within which each corresponding pair of pins reside are linear positioners each indicated at 96. Linear positioners 96 act independently of one another, and each serves through connection means 98 to move slide blocks 86 in a transverse direction and, consequently, each pin a like amount over a range of approximately twelve inches. Linear positioners 96 are commercially available from many sources-the primary requirement being that they function to accurately move slide blocks 86 on command positively and quickly.

Also located within slide blocks 86 is a third set of positioning pins 100, structurally similar to the first and second sets and located just downstream from the first set of pins 84. Pins 100 likewise have individual actuating cylinders 102, serving to move them vertically up and down on command. Pins 100 are, in a neutral position, positioned on a longitudinal line which is spaced laterally upstream from a plane through saws 66-L. Thus, in the embodiment depicted, there are three vertically movable pins within each slide block 86, each of which will move the same distance when its linear positioner 96 operates to move the respective slide block. With independent movement capability, an operator has the capability of moving the pins in one slide block with respect to those in another, thereby providing the ability to skew the cant when it is at the prepositioning station or final positioning and feed station 82.

There is provided at final positioning and feed station 82 a typical longitudinally extending line bar 104, having one vertical wall 106 which, when in the transversely extended position, will be substantially in line with a pre-selected plane relative to the sawing machine. Line bar 104 slides transversely on suitable guide means and is actuated by a plurality of actuating cylinders 108. Actuating cylinders 108 are operatively connected to line bar 104 and serve to move it from a retracted position along the downstream end of conveyor table 20 to an extended position or intermediate positions where it will be in line with pre-selected planes. The line bar 104 is also usable for typical state-of-the-art manual operation, should use of the present invention become disabled for some reason. When using the line bar in manual mode, all of the pins will be retracted and out of the way, and each cant or board will be transversely conveyed to a position abutting the line bar where the operator will then offset the workpiece transversely with respect to a reference line. This operation and procedure is well-known in the art and will not be further described.

At pre-positioning station 80, at least one visually observable line indicated at 110 in FIGS. 4–11, is projected a substantial portion over the longitudinal dimension of conveyor table 20. In the embodiment depicted, line 110 is represented as being a laser light line which will be observable by a human operator positioned appropriately above the horizontal plane of table 20. Line 110 can be projected from above but must be substantially stable and directed in a line substantially parallel to but transversely spaced from the reference plane extending through saws 66-A in the bank of saws. A number of other reference lines could be projected atop conveyor table 20 to represent reference lines in line with but spaced from other individual saws within the bank of saws so that the operator could skew any cant or board with reference to a combination of saw lines. For example, an additional reference line could be projected atop conveyor table 20 which would be parallel to a reference plane through saws 66-C. The operator could then skew the cant or board with respect to that reference line, provided the cant or board is of an appropriate width, thereby affording more uniform saw wear in the banks of saws.

OPERATION OF THE INVENTION

Figure 4:
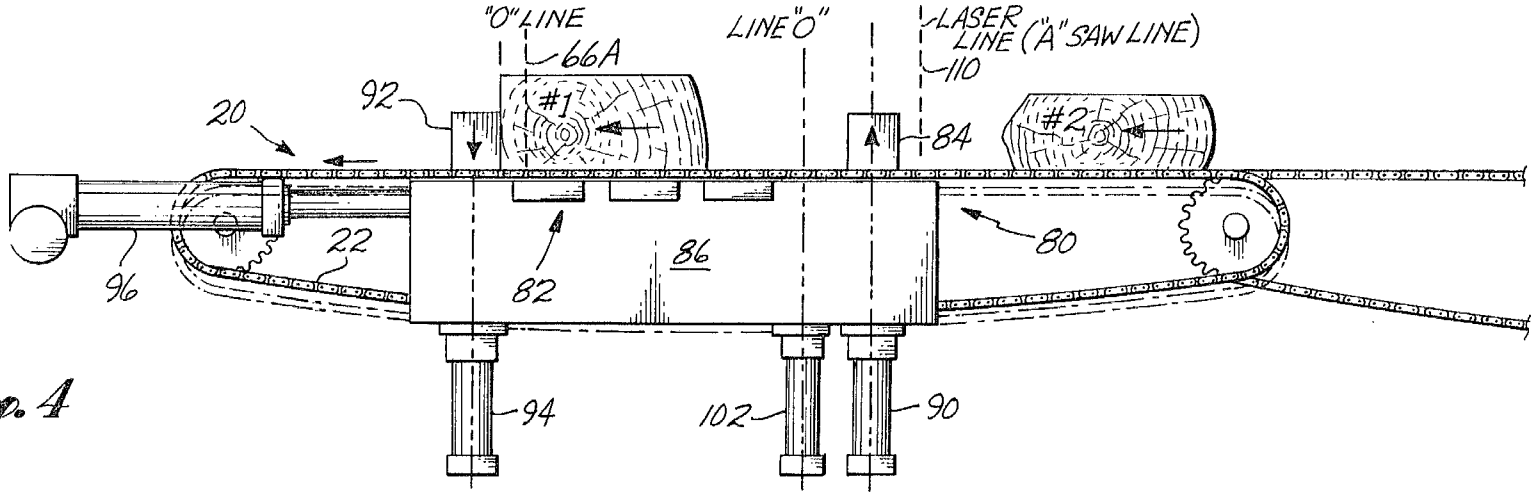
FIGS. 4–11 are schematic representations showing various types of cants as they are prepositioned and finally positioned for conveying through the sawing machine.
Figure 5:
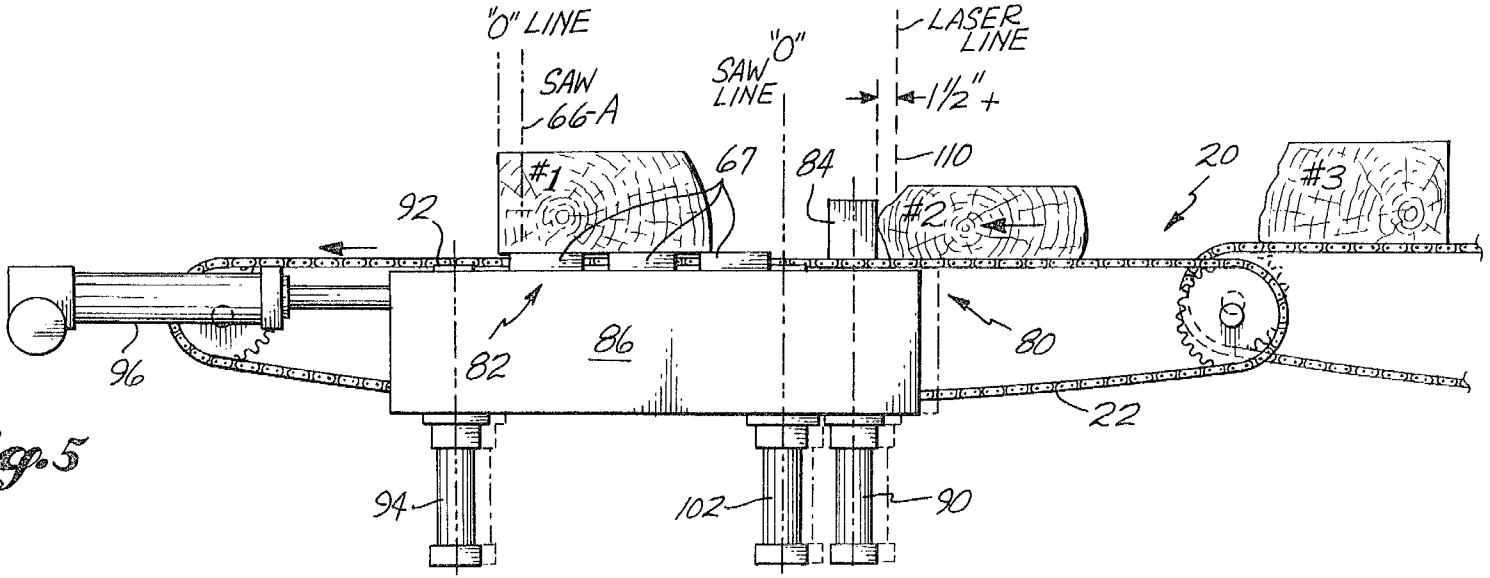

Referring now specifically to FIGS. 4–11, the basic operation and the various modes of operation for different types of cants will be described. In FIG. 4, the cant designated as #1 is shown having just been conveyed atop conveyor table 20 to a position at final positioning and feed station 82 where it is abutting the second set of positioning pins 92. At this point, conveyor table 20 will be in its up position and conveying chains 22 will be moving in the direction indicated-that is, toward positioning pins 92—thereby continually urging cant #1 against the pins. Cant #1 is a so-called "three-sided" cant having the leading side edge aready surfaced with a straight vertical face. With this configuration, the cant is to be positioned so that the vertical face will be substantially in line with a line offset (called the "O" line) a pre-selected distance (the thickness of the piece of lumber to be cut) from the plane through saws 66-A. The position of pins 92 with cant #1 is established by the linear positioners 96 being in their neutral position. With such a three-sided cant, the positions of pins 92 can be set automatically through a suitable control circuit (not shown). Once cant #1 is oriented to its proper position (no skew) for conveying in the longitudinal direction, a control signal will be generated to lower conveyor table 20, thereby placing the cant atop conveyor sections 67 which are stopped. Substantially simultaneously therewith, pins 92 are retracted to their positions below the plane of conveying chains 22. A signal is then generated in the control circuit to start the conveyor sections 67 in a direction to carry cant #1 into and through sawing station 52. As cant #1 passes through the banks of round saw blades, the straight vertical face is offset from saws 66-A. Depending upon the width of cant #1, saws 66-A-66-L will provide the cuts.

At about the time cant #1 leaves positioning and feed station 82 and pins 92 drop, the cant designated as #2 will be entering pre-positioning station 80. A plurality of photo cells or other sensing devices (not shown) may be used to determine the approximate length of any incoming cant, and a signal will be generated to cause two of the positioning pins 84 in the first set to raise. For example, if a long cant on the order of twenty-four feet is fed into station 80, the left-most pin will be raised, as will the right-most pin. Thus, for any cant or board, two pins will be in the elevated position for accepting an incoming cant. When pins 84 are raised, they will be in their neutral position, with their upstream edges at a preset distance from reference line 110, which, in the embodiment depicted, will provide a reference-setting line with respect to saws 66-A.

Cant #2 is typical of cants that are encountered in small log sawmills having top and bottom surfaces that are sawn flat surfaces, and two curvilinear edges that are portions of the log surface. To be cut from cant #2 are the maximum number of pieces of lumber, taking into account wane allowance and the other characteristics of the piece. For example, a wane allowance of up to one-third of the curvilinear edge can be left on the outside board to be cut. With the outside two pins up and cant #2 being continuously conveyed against them by the action of conveying chains 22, the operator, in a cab (not shown), will adjust the transverse position of each pin 84 to set the skew and offset with reference to the longitudinally extending reference line 110.

If, for example, cant #2 has bow in it, the operator may wish to skew the cant with respect to reference line 110, since it is often possible to cut more boards from a bowed cant by skewing it with respect to the saws. In the embodiment depicted, the reference line 110, as previously mentioned, is a laser line which is projected in a plane which will be referenced to saw 66-A but offset therefrom. Therefore, the operator will pre-position the cant with respect to the plane through saws 66-A. If additional light lines are provided, the cant may be positioned with respect to another set of saws.

Figure 6:
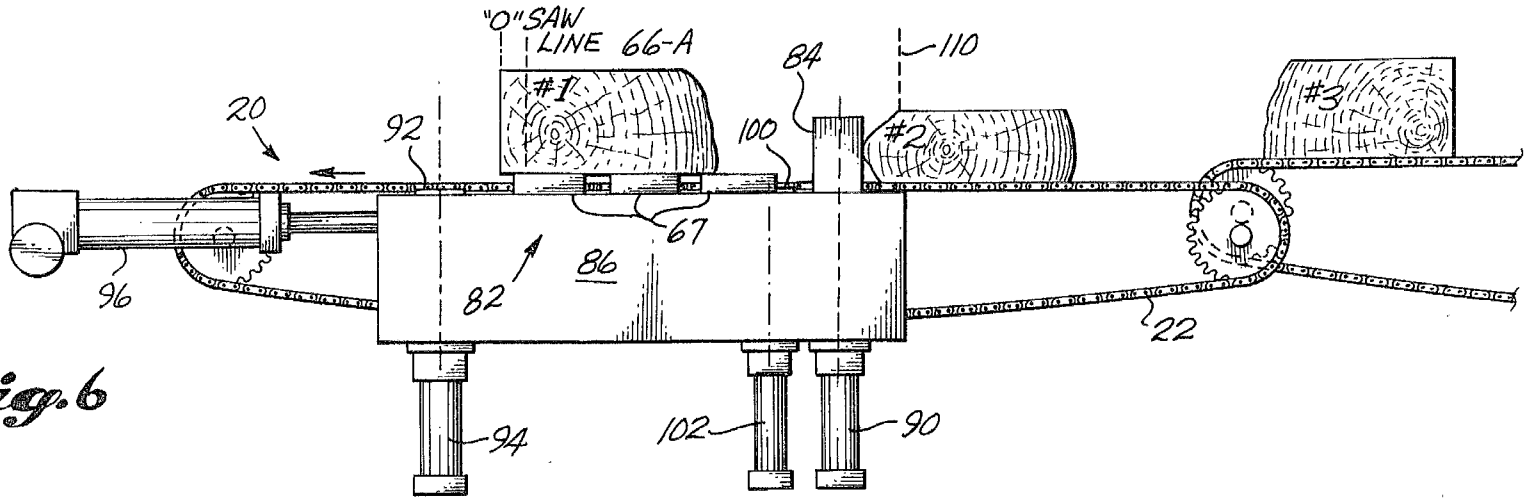

If, for example as depicted in FIG. 6, an operator elects to cut the cant without leaving wane on the downstream outside board, he will move pins 84 accordingly to align the upper edge of the cant to be in line with reference line 110. At the same time the operator is positioning the first set of positioning pins 84, the second set of positioning pins 92 will be moving to become pre-positioned, since slide blocks 86 will carry the second set of pins a like distance. When the cant is properly pre-positioned, the operator will lock the position of the pins within the control system, which will then cause conveyor table 20 to raise and the first set of pins to drop. Cant #2 is then conveyed toward the final positioning and feed station 82 (see FIG. 7) where the second set of pins 92 will be elevated to accept the incoming cant. Since the second set of pins 92 has already been positioned, cant #2 will proceed to its pre-positioned location. After cant #2 has passed over the first set of pins, they will be raised to accept the next incoming cant. At final positioning and feed station 82, assuming the preceding cant has passed through sawing station 52, the conveyor table 20 will then be dropped to place cant #2 atop conveyor sections 67 while, at the same time, the second set of pins will be dropped, thereby allowing cant #2 to be placed in a ready position for conveyance into sawing station 52. Once the second set of pins drops, the control circuit will cause the linear positions 96 to return slide blocks 86 to their neutral positions. Once cant #2 has cleared the positioning and feed station 82, conveyor table 20 may then be raised again.

Figure 7:
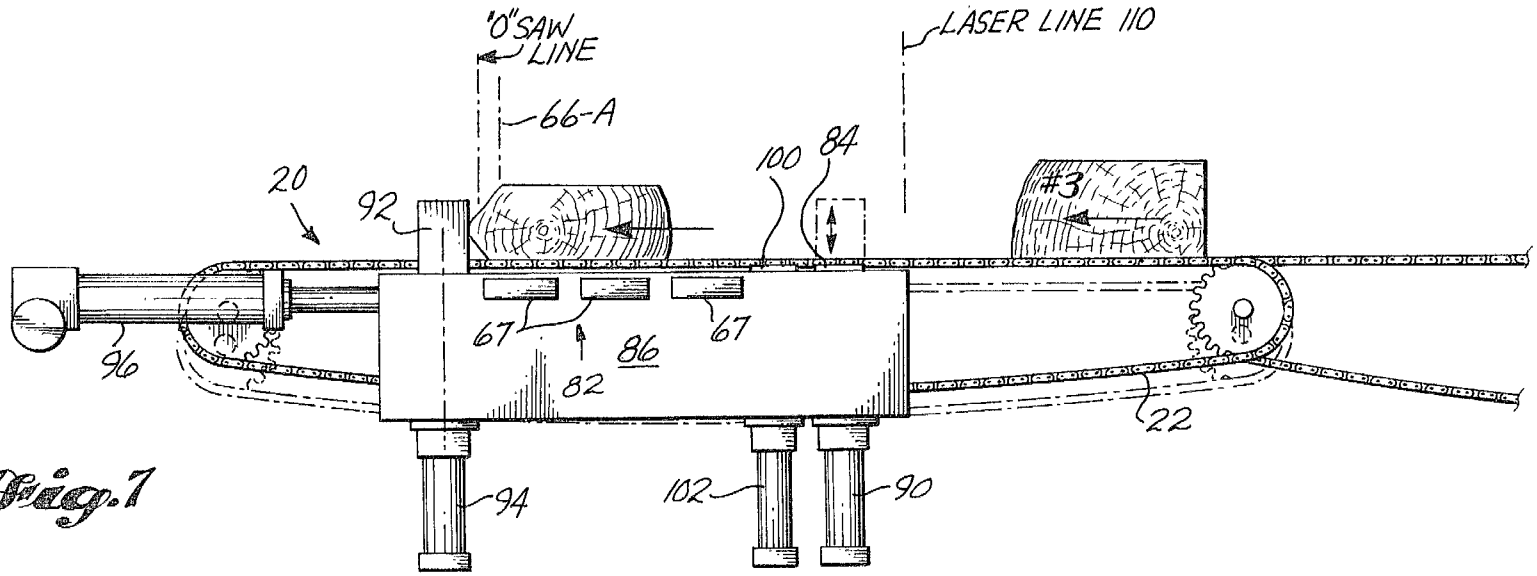
Figure 8:
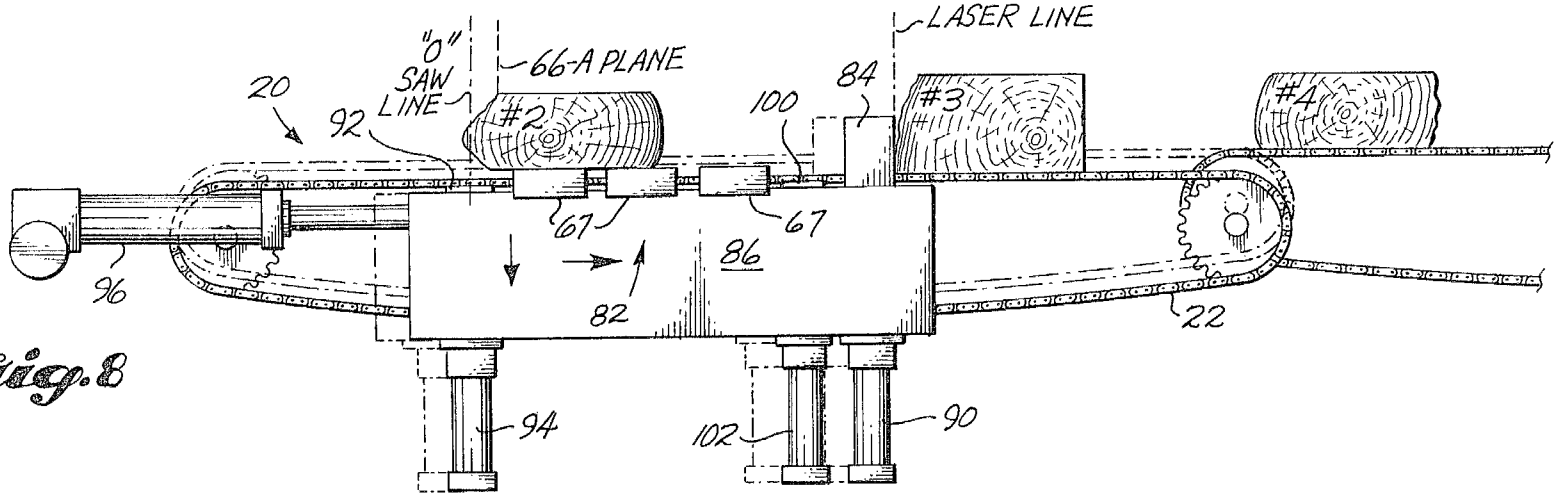
Figure 9:
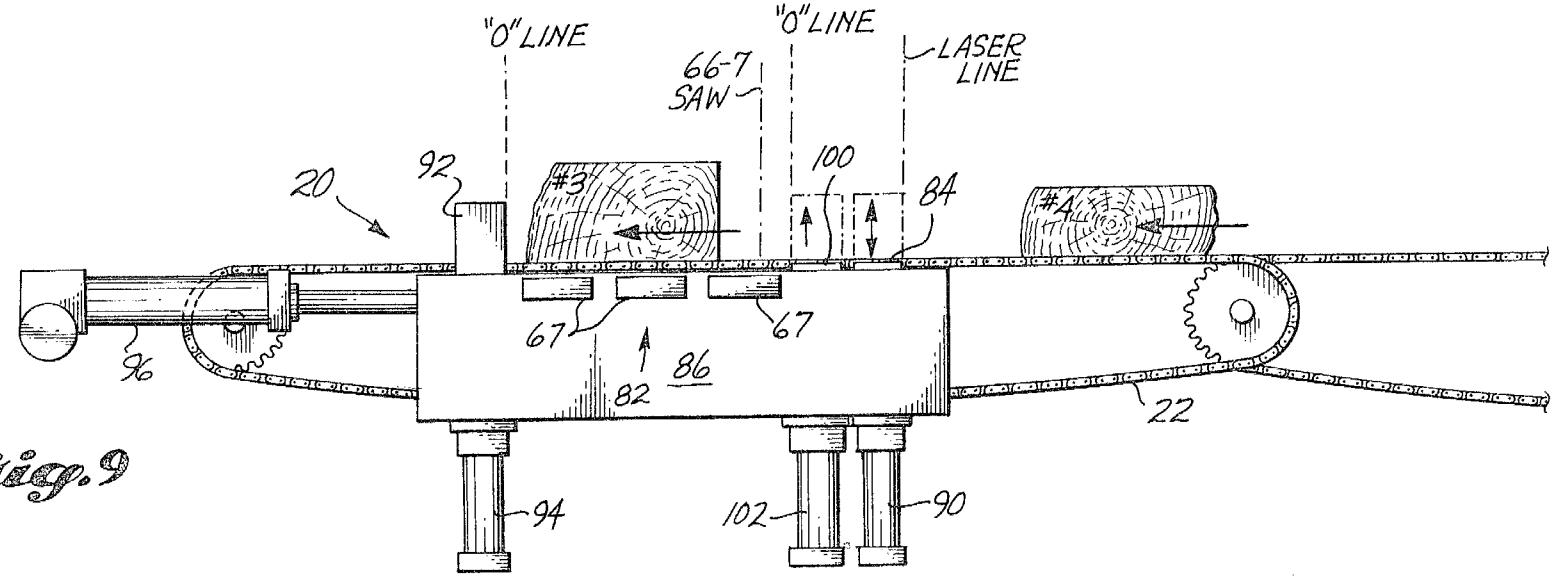
Figure 10:
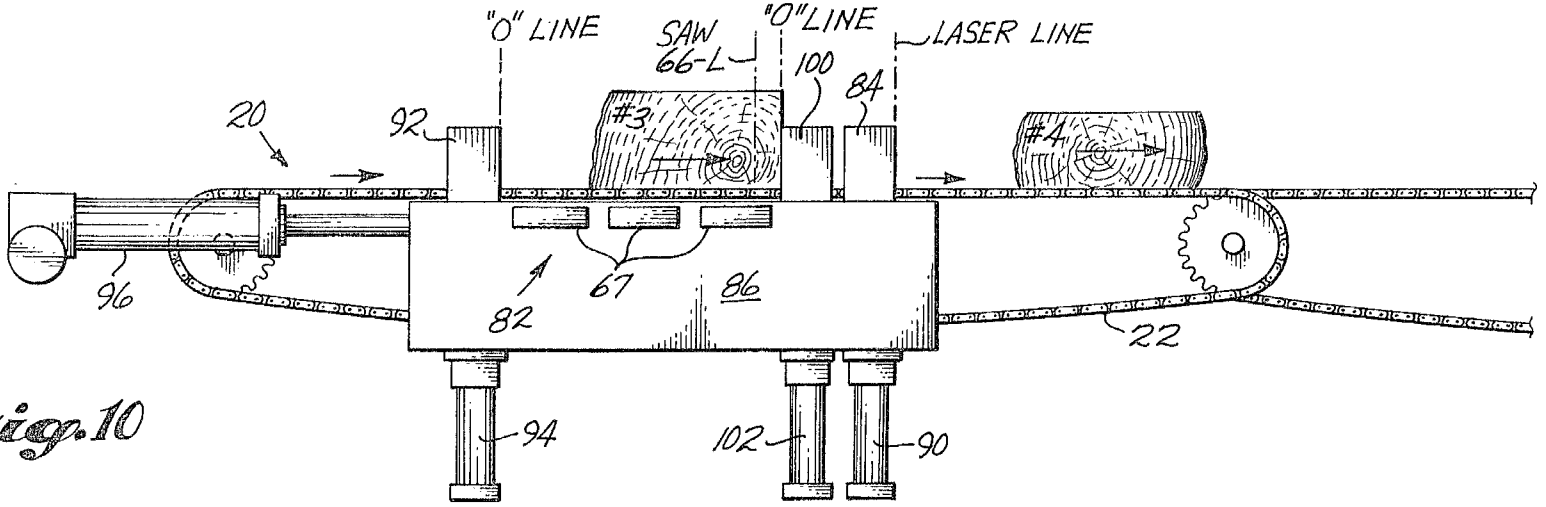
Figure 11:
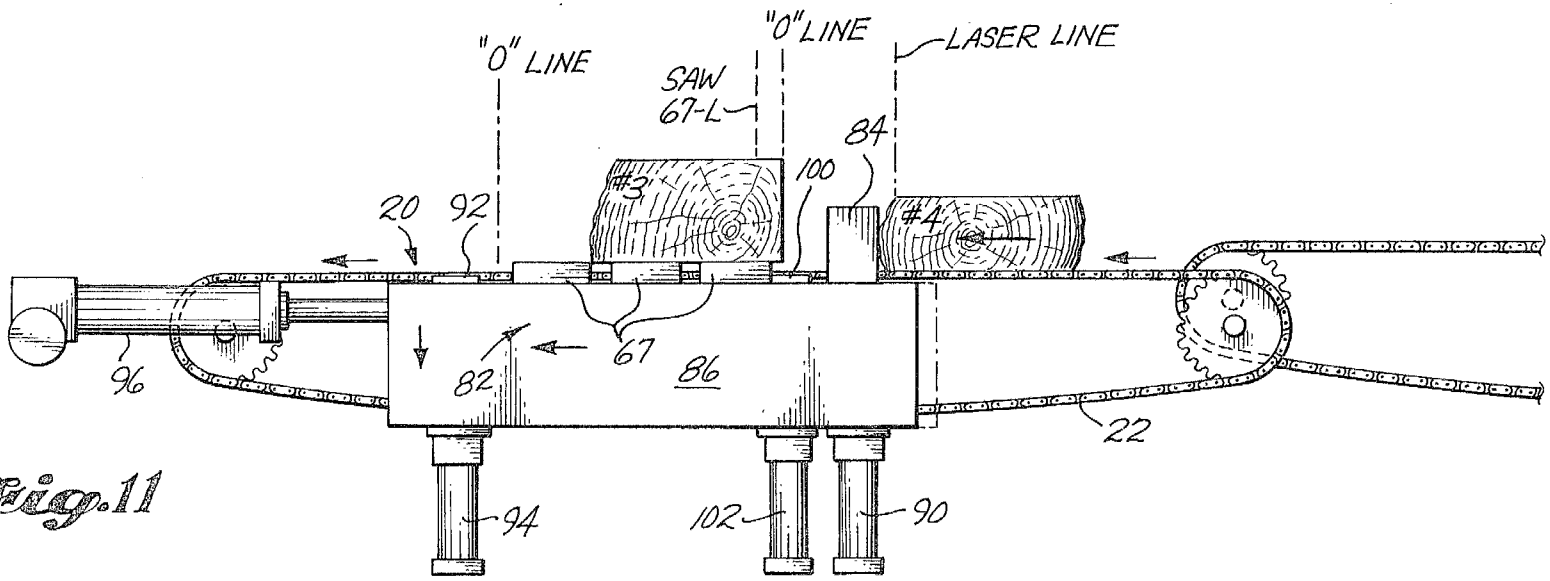

In FIGS. 7 & 8, the next incoming cant, designated as cant #3, is a three-sided cant although with the flat vertical edge along the opposite side compared to cant #1. Here again, since there is already one straight edge, an automatic or simplified positioning step may be performed. In this situation, the third set of positioning pins 100 may be utilized for aligning the straight edge of cant #3 with reference to a saw line and, in this particular case, it will be offset with respect to the L saw line just as cant #1 was offset from the A saw line. An operator, visually observing that cant #3 is a three-sided cant with the straight edge on the upstream side, will activate the control circuit to allow cant #3 to pass over the lowered first set of positioning pins 84 and also the lowered third set of positioning pins 100. After it has passed, (see FIG. 9) its location will be sensed and the conveying chains 22 will be reversed while, substantially simultaneously therewith, the third set of positioning pins 100 (that is, the proper two pins selected from the four) will be raised via their respective actuating cylinders 102. In this case, the downstream side edge of the respective pins 100 will be in line with a reference plane (another so-called "O" saw line) which is offset the thickness of one piece of rough lumber from saws 66-L. This step in the sequence is depicted in FIG. 10 showing cant #3 being continuously urged against the third set of positioning pins 100. Cant #3 could be prepositioned by pins 84 at station 80.

Cant #4, the next incoming cant, is now ready to be prepositioned at station 80. Cant #4, as may be seen, is a cant similar to cant #2. After cant #3 has been positioned against the third set of positioning pins 100, it will be in its final position for conveying longitudinally into sawing station 52. At this point, conveyor table 20 will drop, placing cant #3 atop conveyor sections 67 while, substantially simultaneously therewith, the third set of positioning pins will also drop. The linear positioners 96 will then return the sets of pins to their neutral position and the first set will be raised to accept cant #4. Cant #4 is then pre-positioned by the operator using the appropriately selected two pins with the operator adjusting for skew and offset with respect to the reference lines. After the operator adjusts the position of cant #4, he will set the pin positions for both the first and second sets. A switch is then activated which drops the first set of pins and lifts the conveyor table 20. Pins 100 remain lowered. Substantially simultaneously therewith, the second set of pre-positioned pins are raised to accept cant #4.

It should be appreciated that a significantly improved positioning and feed system for a sawing machine has been described which will allow a greater yield from cants and boards and high production rates through typical sawing machines. Various modifications to the embodiments described will occur to those skilled in the art and all such modifications are intended to come within the scope of the following claims.

What is claimed is:

1. An apparatus for orienting a cant or board with respect to at least one cutting element in a downstream work station where the cants or boards are moved transversely into a position for longitudinal feeding into the work station, comprising:

a pre-positioning station spaced transversely from a plane through the work station and having at least two longitudinally spaced independent vertically and transversely movable pins associated therewith for skewing and orienting a cant or board with respect to a reference line corresponding to a reference plane through the work station, a final positioning and feed station transversely spaced from the pre-positioning station and approximately in line with and upstream from the work station, having at least two longitudinally spaced independent vertically and transversely movable pins associated therewith and having means to move each pin transversely substantially the same distance as the corresponding pin in the pre-positioning station, and means associated with the final positioning and feed station for accepting the pre-positioned cant or board after its transverse movement has stopped and conveying it longitudinally in its pre-positioned orientation through the work station.

2. An apparatus as in claim 1 including a transverse conveyor table means movable vertically relative to the means for longitudinally conveying a cant or board in its pre-positioned orientation.

3. An apparatus as in claim 2 in which the conveyor table means is pivotal about an axis spaced upstream from the final positioning and feed station from a retracted position where it is below the horizontal plane of means for longitudinal conveying to a position where it is above the plane.

4. An apparatus as in claim 3 in which a plurality of pressurizable air bags are longitudinally spaced beneath the conveyor table means and have means associated therewith for sequentially raising and lowering the table means.

5. An apparatus as in claim 1 further including means for selectively raising two of the plurality of pins at the pre-positioning station in response to the length of an incoming cant or board and the corresponding same two pins at the final positioning and feed station.

6. An apparatus as in claim 1 in which each pin is connected to a vertically mounted actuating cylinder located below the horizontal plane of transverse movement of cants or board.

7. An apparatus as in claim 1 in which the corresponding sets of pins are mounted within transversely movable slide blocks located below the horizontal plane of transverse movement of cants or boards.

8. An apparatus as in claim 1 including a third set of positioning pins located within the final positioning station and being longitudinally spaced from each other and vertically and transversely movable for orienting the longitudinally extending upstream edge of a cant or board with respect to a cutting element in the work station.

9. An apparatus as in claim 1 in which the reference line is a reflected visible line of laser light.

10. An apparatus as in claim 9 further including additional reference lines spaced from the work station corresponding to pre-selected reference planes through the work station.

11. An apparatus as in claim 10 in which a plurality of the reference lines correspond with reference planes through saws in the work station.

* * * * *